US006165002A

United States Patent [19]

Kalis

[11] Patent Number: 6,165,002

[45] Date of Patent: Dec. 26, 2000

[54] ELECTRICAL CONNECTOR APPARATUS

[75] Inventor: Robert M. Kalis, Overland Park, Kans.

[73] Assignee: Garmin Corporation, Taiwan

[21] Appl. No.: 09/223,552

[22] Filed: Dec. 30, 1998

[51] Int. Cl.[7] ..... H01R 13/627

[52] U.S. Cl. ..... 439/358; 439/357

[58] Field of Search ..... 439/352, 357, 439/253, 258, 358

[56] References Cited

U.S. PATENT DOCUMENTS

| | | | |
|---|---|---|---|
| 2,456,548 | 12/1948 | Weiner et al. | 173/361 |
| 3,737,835 | 6/1973 | Clement et al. | 339/45 R |
| 4,750,890 | 6/1988 | Dube et al. | 439/152 |
| 5,171,291 | 12/1992 | d'Alayer de Costemore d'Arc et al. | 439/152 |
| 5,197,901 | 3/1993 | Hashiguchi | 439/352 |
| 5,275,573 | 1/1994 | McCleerey | 439/159 |
| 5,383,794 | 1/1995 | Davis et al. | 439/352 |
| 5,637,003 | 6/1997 | Takahashi | 439/157 |
| 5,655,916 | 8/1997 | Hayashi | 439/155 |
| 5,980,335 | 11/1999 | Barbieri et al. | 439/824 |

*Primary Examiner*—Brian Sircus
*Assistant Examiner*—Chandrika Prasad
*Attorney, Agent, or Firm*—Shook, Hardy & Bacon, L.L.P.

[57] ABSTRACT

A connector is provided for connecting an accessory such as an antenna, external power source, programming cable or the like to a mobile phone or other appliance. The appliance includes a housing presenting an end wall through which at least one electrical contact is accessible, and a pair of posts secured to and protruding from the end wall. The connector includes axially spaced end walls and a pair of side wall portions that are generally diametrically opposed to one another. Each of the end walls include a pair of protrusions that extend laterally beyond the side wall portions such that each of the protrusions of the one end wall are spaced axially from one of the protrusions of the opposite end wall. A spring clip is supported on the housing by each pair of axially opposed protrusions, and the clips include elongated body portions extending between the axially opposed protrusions, and distal ends that protrude axially beyond the distal end wall protrusions. The distal ends of the clips present hooks sized for engagement with the posts when the connector is pressed against the end wall of the appliance such that the connector can be secured to the appliance with an electrical contact of the connector engaged with a contact of the appliance. The bodies of the spring clips are normally spaced laterally from the side wall portions of the housing to define a locking position of the clips, and are deformable to allow the bodies to be pressed laterally inward toward one another to unhook the clips from the posts such that the connector can be released and removed from the appliance.

7 Claims, 2 Drawing Sheets

ELECTRICAL CONNECTOR APPARATUS

BACKGROUND OF THE INVENTION

The present invention relates generally to electrical connectors, and more particularly to a releasable electrical connector apparatus for use in connecting various types of accessories to appliances such as mobile cellular phones and the like.

As the applications for mobile appliances increase with new technical developments, the need arises for more reliable electrical connectors to permit accessories such as external power sources, antennas, programming cables and the like to be positively locked in place on such appliances without the risk of being inadvertently disconnected or removed therefrom. In addition, because of the nature of mobile appliances as being hand-held devices, it is important that accessories be easy to use, and that the connectors associated with accessories be capable of single-handed, single-step connection and disconnection.

An example of a known electrical connector is shown in U.S. Pat. No. 5,655,916, issued Aug. 12 1997, to Hayashi. The connector includes first and second connector portions, and a spring is mounted in one of the portions such that if the connector is released prior to complete and proper electrical connection, the connector portions are moved away from each other by the spring to visibly and clearly indicate an incomplete or inadequate connection. A pair of laterally opposed lock arms are hingedly mounted on the distal end of one of the connector portions and engage retaining holes in a hood of the other connector portion to lock the portions together. In order to disconnect the portions, the lock arms are depressed, releasing the arms from the holes and freeing the portions for separation from one another.

Although the known type of electrical connector provides a positive locking action while permitting single-handed, single-step operation, it is not suitable for use on small, hand-held mobile appliances such as cellular phones and the like because of the space requirements of the hood-and-lock arm arrangement of the mechanism. In addition, the use of hinged lock arms in the known mechanism necessitates the use of U-shaped leaf springs, increasing the cost and complexity of the arrangement, and rendering the construction unreliable in harsh outdoor environments such as at sea.

BRIEF SUMMARY OF THE INVENTION

It is an object of the present invention to provide an electrical connector apparatus that addresses the technical problem left unsolved by the prior art, wherein the apparatus is simple, waterproof, compact, and inexpensive to construct, and is capable of single-handed, single-step operation to provide a positive locking connection between a mobile appliance and its accessories.

In accordance with this and other objects evident from the following description of a preferred embodiment of the invention, an electrical connector apparatus is provided which includes a housing and a pair of clips. The housing presents axially spaced proximal and distal end walls and a side wall extending longitudinally between the end walls, and the side wall includes a pair of side wall portions that are generally diametrically opposed to one another. Each of the end walls includes a pair of protrusions that extend laterally beyond the side wall portions such that each of the protrusions of the proximal end wall are spaced axially from one of the protrusions of the distal end wall. One of the spring clips is supported on the housing by each pair of axially opposed protrusions, and the clips include elongated body portions extending between the axially opposed protrusions, and distal ends that protrude axially beyond the distal end wall protrusions. The bodies of the clips are normally spaced laterally from the side wall portions of the housing to define a locking position of the clips, and are deformable to allow the bodies to be pressed laterally inward toward one another to move the distal ends to an unlocking position.

By providing a construction in accordance with the present invention, numerous advantages are achieved relative to the prior art. For example, by employing a housing that supports a pair of clips in spaced relation to opposed side wall portions thereof, a simple construction results in which the clips are presented for positive locking engagement with cooperating structure on an appliance. In addition, the construction allows single-handed, single-action locking and unlocking of the apparatus which facilitates use thereof with hand-held mobile appliances such as cellular phones and the like.

Another advantage realized by the present invention is that by supporting the clips outboard of the housing, it is easier to seal the housing than would otherwise be the case, and the likelihood of the apparatus leaking water during use in harsh marine environments is dramatically reduced relative to conventional constructions. This advantage of the invention is furthered by the use of a housing formed from at least two separate housing elements that are secured together, wherein the proximal and distal end walls are formed in different ones of the elements.

In accordance with one aspect of the invention, the appliance adapted for use with the inventive connector apparatus includes a pair of posts that serve the dual functions of securing a socket board of the appliance in place while presenting post heads sized and positioned for engagement by the clips of the apparatus. In addition, the posts are replaceable in the event they wear out, thus extending the useful life of the construction.

BRIEF DESCRIPTION OF THE SEVERAL VIEWS OF THE DRAWING

The preferred embodiment of the present invention is described in detail below with reference to the attached drawing, wherein.

DETAILED DESCRIPTION OF THE INVENTION

Figure 1:
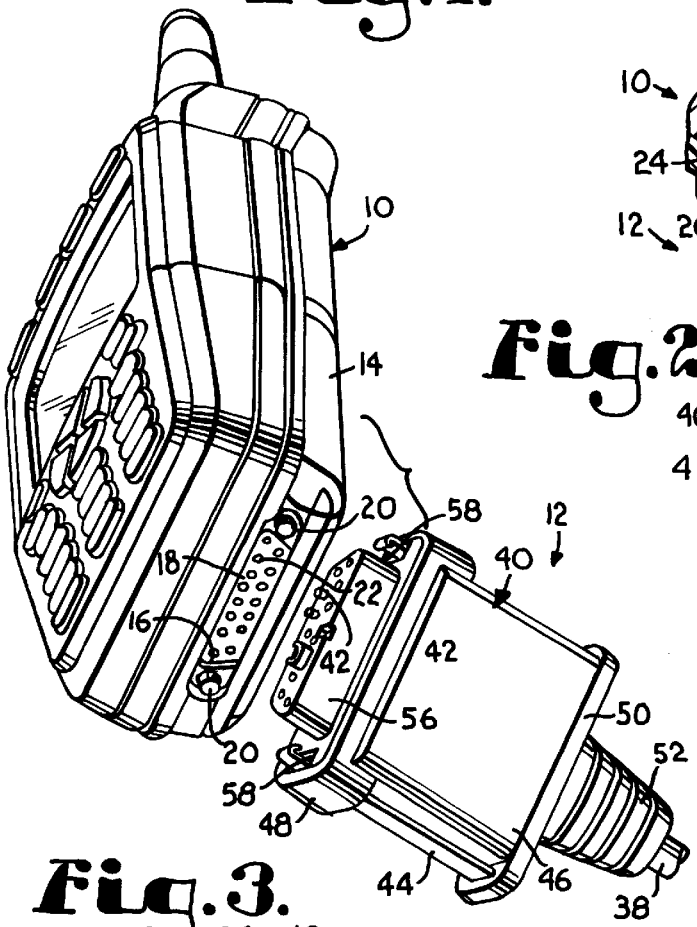
FIG. 1 is a perspective view of an appliance and a connector constructed in accordance with the preferred embodiment of the present invention.

An appliance 10 and an electrical connector apparatus 12 constructed in accordance with the preferred embodiment are illustrated in FIG. 1. The appliance 10 is a cellular or digital telephone that incorporates a global positioning system such that the appliance can be used both as a telephone for transmitting voice and data signals, and as a global positioning device for generating, transmitting and displaying global position information. Although the appliance has many applications, it is particularly adapted for outdoor or marine applications, wherein the phone can be used not only as a means of communicating with third parties, but also as a means of displaying the geographical positions of the user and/or the third parties relative to a map.

Any desired accessory can be adapted for use with the appliance, e.g. an external power source, an antenna, a programming cable, or the like, by providing the accessory with an electrical connector apparatus 12 constructed in accordance with the present invention. The electrical connector apparatus cooperates with corresponding structure on the appliance to provide a secure positive engagement between the connector apparatus and the appliance so that the accessory cannot be inadvertently disconnected from the appliance during use.

In the illustrated embodiment, the appliance 10 includes a housing 14 presenting a female electrical connector arrangement, and the accessory presents a male arrangement. However, it is understood that this construction could be reversed such that the male portion thereof would be by the appliance and the female portion by the accessory. As such, the following description is simply illustrative of the invention, and should not be considered limiting in this respect.

Figure 2:
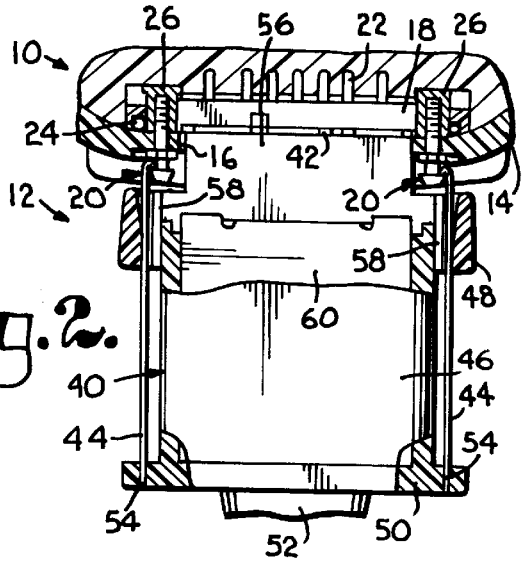
FIG. 2 is a fragmentary front elevational view, partially in section, of the appliance and connector, illustrating the connector in an engaged and locked position relative to the appliance.

The housing 14 of the appliance includes a shaped aperture 16 in an end wall thereof, and a socket of the connector arrangement is mounted within the aperture by a pair of laterally spaced posts 20. The aperture can be of any desired shape, but preferably is non-symmetrical such that the male and female portions of the arrangement can only be engaged with one another in a single orientation. In the illustrated embodiment, the aperture 16 is trapezoidal, including parallel upper and lower edges, and marginal edges that are non-parallel to one another. As shown in FIG. 2, a pair of laterally spaced holes are also provided in the end wall of the housing, and the holes are spaced slightly outboard of the marginal edges of the aperture so as to receive the posts.

The socket board 18 of the connector arrangement includes a solid, generally planer piece of synthetic resin material or similarly electrically insulative material. The socket board includes a central region that is positioned within the opening defined by the aperture upon assembly of the appliance, and a peripheral region that borders the aperture in the housing such that the board overlaps the material of the housing along all sides of the aperture 16.

The central region of the socket board 18 is provided with at least one hole within which an electrical contact 22 is mounted. The electrical contact 22 is exposed within the hole, and preferably presents an end flush with the socket board or slightly recessed. The space between the contact and the board is sealed to prevent leakage of water past the contact during use.

The peripheral region of the socket board 18 includes a groove that faces the end wall of the housing 14 and extends around the central region of the board, and a resilient sealing ring 24 formed of an elastomeric material such as natural or synthetic rubber is received between the socket board and the housing to seal the housing against leakage. A pair of laterally spaced holes are formed in the socket board 18 inboard of the sealing ring 24, and a cup-shaped socket 26 is mounted in each of the holes. Each socket 26 is sealed to the socket board to prevent leakage through the holes, and includes a cylindrical inner surface that is threaded to receive one of the posts 20 so that the posts can be used during assembly to draw the socket board into sealing engagement against the interior of the end wall of the housing 14. As such, a water-tight fit is provided between the socket board and the housing which prevents water from entering the housing through the aperture 16 during use of the appliance.

Figure 4:
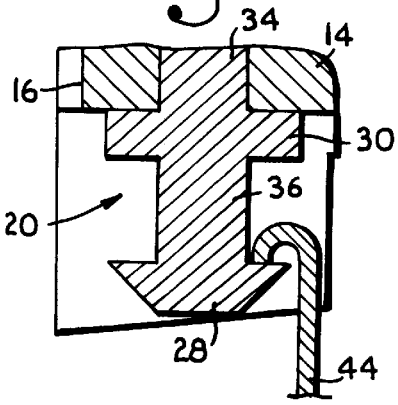
FIG. 4 is a further enlarged fragmentary view of the appliance and connector, illustrating the inter-engagement of a post and clip forming a part of the combination.
Figure 5:
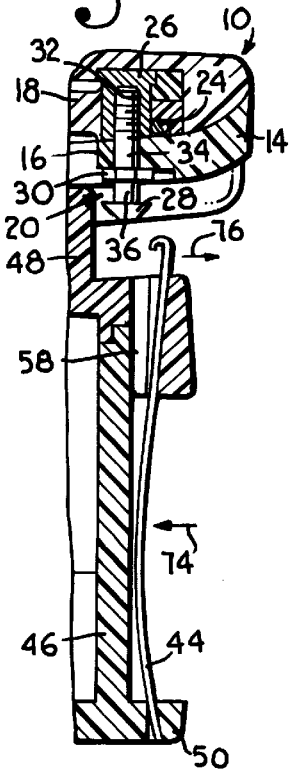
FIG. 5 is a enlarged fragmentary view of the appliance and connector, illustrating the connector in an unlocked and withdrawn position relative to the appliance.

As shown in FIG. 5, each post 20 generally includes a distal portion that is threaded for receipt in the sockets, a proximal portion presenting an enlarged head 28 by which the post can be engaged by the male portion of the connector arrangement, and an intermediate flange 30 by which the post can be gripped by a tool and turned. The distal portion preferably includes a threaded distal section 32 that engages one of the sockets, and a proximal shank 34 corresponding in length to the thickness of the end wall of the housing. The proximal portion of each post includes a cylindrical shank 36 presenting a first diameter, and the proximal head 28 which presents a diameter larger than that of the shank 36. Preferably, as shown in FIG. 4, the head 28 includes a substantially flat outer face, a substantially flat annular inner face, and a tapered side wall that presents a relatively small diameter at the outer face, and a relatively large diameter at the inner face.

Returning to FIG. 1, the accessory connected to the apparatus 12 can take the form of any known or developed apparatus capable of being electrically coupled to the appliance, and includes an insulated cable or wire 38 for forming a circuit with the appliance, and the connector apparatus 12 for connecting the cable or wire to the contact 22 of the appliance 10. The connector apparatus 12 broadly includes a housing 40 that supports both an electrical contact assembly 42 for engaging the electrical contact 22 of the appliance, and a pair of clips 44 that are movable between locking and unlocking positions for positively locking the apparatus to the appliance to prevent the apparatus from becoming disconnected inadvertently during use.

The housing 40 is formed of an electrically insulative material such as synthetic resin, and includes two separate housing elements 46, 48 that are permanently secured together during manufacture. The proximal element 46 is generally box-like in shape, including an end wall 50 and a plurality of longitudinally extending side wall portions including a pair of side walls portions 47 and 49. The distal end of the element 46 is open, and presents a circumferential edge that is shaped for receipt of the distal housing element 48. The end wall 50 is generally planer, and includes a central aperture through which the cable or wire of the accessory extends. A tubular grommet 52 formed of any suitable elastomeric material such as natural or synthetic rubber is fitted in the aperture, and seals the aperture around the cable or wire 38 to prevent water from entering the housing 40 through the aperture. As shown in FIG. 5, the end wall 50 of the proximal housing element 46 protrudes slightly beyond two opposing portions of the side wall to present mounting flanges. Each mounting flange includes a generally rectangular hole or slot 54 spaced laterally outward from the side wall, e.g. by a distance of 1–3 mm.

As illustrated in FIG. 1, the distal housing element 48 defines the distal end wall of the housing, and includes a circumferential edge that is shaped for receipt of the distal end of the element. The two edges are permanently secured together in sealing engagement with one another during assembly so that water cannot leak into the housing between the elements during use. The distal element 48 also includes a male protrusion 56 that is shaped for receipt in the aperture 16 of the appliance so that the connector apparatus 12 can only be connected to the appliance in a single orientation. The shape of the male protrusion 56 in the illustrated embodiment is trapezoidal, including parallel upper and lower sides, and marginal sides that are non-parallel to one another.

As shown in FIG. 5, the distal housing element protrudes slightly beyond two of the side wall portions 47 and 49 of the element 46 to present mounting flanges that are aligned with the flanges defined by the end wall 50. Each mounting flange also includes a longitudinally extending portion that extends along the side wall portions, and an axially extending hole or slot 58 spaced laterally outward from the side wall, e.g. by a distance of 1–3 mm. Each hole 58 is partially defined by an outer wall that is sloped relative to the longitudinal axis of the housing such that the width of the hole varies between a relatively large distal mouth and the proximal end thereof. Each hole also is partially defined by an inner wall that is stepped to present a central, inwardly directed notch that accommodates the distal end of one of the clips during assembly.

Figure 7:
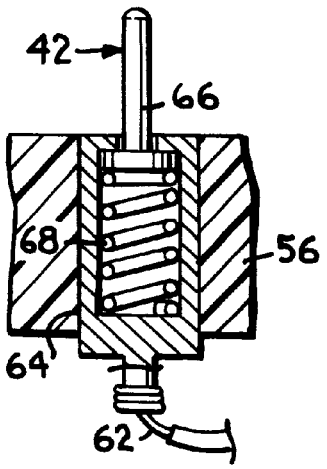
FIG. 7 is a fragmentary sectional view of an electrical contact assembly forming a part of the apparatus.

As shown in FIG. 2, the cable or wire 38 of the accessory terminates within the housing 40 of the apparatus, and a circuit board 60 may be provided, if necessary, to adapt the accessory for connection to the contact of the appliance. The circuit board, in turn, is electrically connected to the contact assembly 42 of the apparatus by conventional conductive leads 62, shown in FIG. 7. The contact assembly 42 of the apparatus protrudes through the male protrusion 56 of the housing, and is preferably sealed in place to prevent leakage of water into the housing during use. As such, the entire housing 40 is sealed against leakage, enabling use of the apparatus outdoors, e.g. in marine applications.

The contact assembly 42 includes a sleeve 64 that is secured to the housing of the apparatus and fixed against relative movement, and an inner contact element 66 that is telescopically received in the sleeve for relative axial movement between extended and retracted positions, wherein electrical contact between the sleeve and the inner element is constantly maintained. A spring 68 is seated in the sleeve 64 between an end wall of the sleeve and an end of the inner contact element 66 for biasing the element 66 axially outward toward the extended position. By providing this construction, and by positioning the contact assembly with the open distal end of the sleeve 64 flush with the end face of the male protrusion 56, the inner contact element 66 projects beyond the end face of the protrusion for engagement with the contact of the appliance when the apparatus is connected to the appliance. Although the preferred embodiment has been described with reference to a single contact of the appliance and a single contact assembly of the connector apparatus, it is understood that any desired number of electrical contacts may be employed depending on the application of the invention, and the invention is not limited in this respect.

Figure 6:
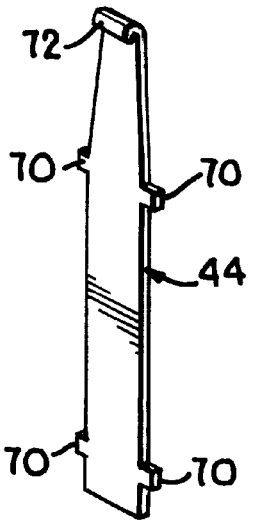
FIG. 6 is a perspective view of the clip.

Turning to FIG. 6, each clip 44 includes a unitary strip of resilient metal or the like having a uniform thickness and presenting a body portion and an end portion. The body portion is generally rectangular, and includes four projections 70 that protrude from the side edges there of by a short distance. The projections on each side of the body are spaced axially from one another by a distance corresponding to the distance between the mounting flanges of the housing so that the clip is retained against longitudinal shifting movement relative to the proximal end wall 50 during use. The end portion of each clip includes a width that narrows toward the distal end of the clip, and an in-turned hook 72 is formed at the distal end for engaging one of the posts of the appliance during use.

With reference to FIG. 2, during manufacture of the apparatus, the clips 44 are positioned in the holes 54 of the proximal mounting flanges of the housing element 46, and the distal element 48 is fitted on the element 46 with the distal ends of the clips 44 received in the holes 58. The notched portions of the holes 58 allow this assembly of the clips, while maintaining a spacing between the clips and the side wall portions of the element 46. As such, in the assembled condition of the housing, the clips 44 are spaced laterally of the side wall portions by a predetermined distance, e.g. 1–3 mm.

Figure 3:
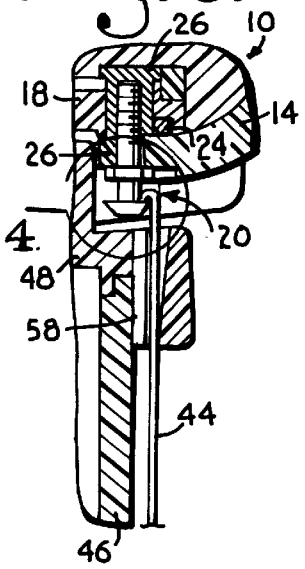
FIG. 3 is an enlarged fragmentary view of the appliance and connector, illustrating the connector in an engaged and locked position relative to the appliance.

In order to connect an accessory to the appliance, the connector apparatus 12 is simply aligned with the aperture 16 in the appliance housing 14, and the male protrusion 56 is inserted in the aperture. As the apparatus is pushed into engagement with the appliance, the hooks of the clips 44 engage the heads 28 of the posts 20, urging the clips outward. This resilient action of the clips is accommodated by the spacing between the housing 40 and the clips 44, and allows the clips to ride over the post heads into engagement with the posts. Thereafter, the apparatus is positively locked to the appliance, as shown in FIGS. 2–4, and cannot be removed without further manipulation of the clips.

When the apparatus 12 is connected to the appliance 10, the inner contact element of the electrical contact assembly 42 of the apparatus engages the contact 22 of the socket board, and is depressed slightly against the action of the spring. As such, an outward pressure is exerted on the contact elements that tends to push the connector from the aperture when the clips 44 are disengaged from the posts 20. If the hooks 72 of the clips do not engage the posts during connection, the spring of the assembly 42 tends to push the connector back away from the appliance, preventing partial connection that might otherwise permit an inadvertent subsequent disconnection.

When it is desired to disconnect the accessory from the appliance, the clips 44 are gripped and squeezed toward one another in the direction shown by arrow 74 in FIG. 5, causing the distal ends of the clips to bend laterally outward in the direction indicated by the arrow 76 about the fulcrum defined by the distal mounting flanges. As such, the hooks 72 clear the heads of the posts and the spring of the contact assembly urges the connector away from the socket board. Thus, although the connector is positively locked in place on the appliance, it is possible to single-handedly disconnect the apparatus with a single action to free the accessory from the appliance. This construction facilitates use of the apparatus with mobile appliances that are typically hand-held such that connection and disconnection are possible while the appliance is being held and/or used.

Although the invention has been described with reference to the preferred embodiment illustrated in the attached drawing, it is noted that substitutions may be made and equivalents employed herein without departing from the scope of the invention as recited in the claims.

What is claimed:

1. An electrical connector apparatus comprising:

a housing presenting axially spaced proximal and distal end walls and a side wall extending longitudinally between the end walls, the side wall including a pair of side wall portions that are generally diametrically opposed to one another, each of the end walls including a pair of protrusions that extend laterally beyond the side wall portions such that each of the protrusions of the proximal end wall are spaced axially from one of the protrusions of the distal end wall; and a clip supported on the housing by each pair of axially opposed protrusions, the clips including elongated body portions extending between the axially opposed protrusions, and distal ends that protrude axially beyond the distal end wall protrusions, the bodies of the clips normally being spaced laterally from the side wall portions of the housing to define a locking position of the clips, and being deformable to allow the bodies to be pressed laterally inward toward one another to move the distal ends to an unlocking position.

2. The electrical connector apparatus as recited in claim 1, wherein the housing is formed from at least two separate housing elements that are secured together, and the proximal end wall is formed in a different one of the housing elements than the distal end wall.

3. The electrical connector apparatus as recited in claim 1, wherein the end and side walls of the housing define an interior space and the clips are supported on the housing exteriorly of the interior space.

4. The electrical connector apparatus as recited in claim 1, wherein the housing is formed of an electrically insulative material.

5. The electrical connector apparatus as recited in claim 1, further comprising at least one pin connector assembly including a tube sealed to the housing, a pin protruding from the tube, and a spring received in the tube and seated against the tube and the pin to exert an axially extending force on the pin.

6. The electrical connector apparatus as recited in claim 2, further comprising a grommet sealed to the second portion of the housing.

7. In combination:

an appliance including a housing presenting an end wall, at least one electrical contact accessible through the end wall, and a pair of posts secured to and protruding from the end wall, each of the posts including an enlarged head; and an accessory adapted to be connected to the appliance, the accessory including an electrical connector presenting an end wall and at least one electrical contact accessible through the end wall, the connector further including;

axially spaced proximal and distal end walls, a pair of side wall portions that are generally diametrically opposed to one another, each of the end walls including a pair of protrusions that extend laterally beyond the side wall portions such that each of the protrusions of the proximal end wall are spaced axially from one of the protrusions of the distal end wall, and a clip supported on the housing by each pair of axially opposed protrusions, the clips including elongated body portions extending between the axially opposed protrusions, and distal ends that protrude axially beyond the distal end wall protrusions, the distal ends presenting hooks sized for engagement with the heads of the posts when the connector is pressed against the end wall of the appliance such that the connector can be secured to the appliance with the at least one contact of the connector engaged with the at least one contact of the appliance, the bodies of the clips normally being spaced laterally from the side wall portions of the housing to define a locking position of the clips, and being deformable to allow the bodies to be pressed laterally inward toward one another to unhook the clips from the posts such that the connector can be released and removed from the appliance.

* * * * *